US005193622A

United States Patent [19]

Tibbling

[11] Patent Number: 5,193,622

[45] Date of Patent: Mar. 16, 1993

[54] DEVICE FOR PREVENTING THE RISK OF FIRE DUE TO BURNING OR GLOWING PARTICLES IN A PIPELINE

[75] Inventor: Kurt Tibbling, Huddinge, Sweden

[73] Assignee: Firefly AB, Huddinge, Sweden

[21] Appl. No.: 74,488

[22] PCT Filed: Nov. 24, 1986

[86] PCT No.: PCT/SE86/00537

§ 371 Date: Jul. 2, 1987

§ 102(e) Date: Jul. 2, 1987

[87] PCT Pub. No.: WO87/03210

PCT Pub. Date: Jun. 4, 1987

[30] Foreign Application Priority Data

Nov. 29, 1985 [SE] Sweden ..... 8505637

[51] Int. Cl.[5] ..... A62C 35/10

[52] U.S. Cl. ..... 169/54; 169/48; 169/60

[58] Field of Search ..... 169/54, 48, 60, 61, 169/64, 49

[56] References Cited

U.S. PATENT DOCUMENTS 347,794 8/1886 Hexamer ..... 169/54

2,989,348 6/1961 Reed ..... 169/54

FOREIGN PATENT DOCUMENTS 2535431 2/1977 Fed. Rep. of Germany .

2939151 4/1980 Fed. Rep. of Germany .

3141160 5/1983 Fed. Rep. of Germany ..... 169/48

3215076 10/1983 Fed. Rep. of Germany ..... 169/48

8303552 10/1983 World Int. Prop. O. ..... 169/48

*Primary Examiner*—Joseph F. Peters, Jr.

*Assistant Examiner*—Thomas J. Brahan

*Attorney, Agent, or Firm*—Sandler Greenblum & Bernstein

[57] ABSTRACT

A device for eliminating fire risk due to hot particles (12) in the form of burning or glowing material passing within a pipeline (10). The device includes a valve (18) which can be controlled to block the pipeline when a risk of fire is indicated in the pipeline and/or connected parts, and a container (16) with an extinguishing agent. The extinguishing agent intended to be fed into the pipeline (10) as the pipeline is blocked by the valve preferably consists of a gas or liquid. The container (16) is connected to the valve (18) via a line (10) for the extinguishing agent. In this way, an extinguishing agent passing out of the container (16) will initiate the release of the valve (18).

5 Claims, 1 Drawing Sheet

DEVICE FOR PREVENTING THE RISK OF FIRE DUE TO BURNING OR GLOWING PARTICLES IN A PIPELINE

BACKGROUND OF THE INVENTION

1. Field of the Invention

This invention relates to a device for eliminating the risk of fire due to hot particles which may be burning or glowing as they pass in the longitudinal direction of a pipeline by means of i) a valve which can be controlled to block a pipeline when a risk of fire is indicated in the pipeline and/or connected parts, and ii) a container with an extinguishing agent, in the form of a gas or liquid, intended to be fed into the pipeline in connection with its blocking.

2. Description of Related Art

The invention is useful for example in pneumatic transport of combustible particles, e.g. in the form of cellulose fibres, within pipelines in connection with working or drying material. A detector that can be of the type taught in Swedish patent 364 588 is utilized for detecting, sensing, or otherwise indicating risk of fire occuring in the pipeline. The detector will cause release of a valve, e.g. of the type described in Swedish patent 7503401-7, in an electric way. A so-called explosive release of the valve will then be provided by a pin release means. A similar pin release means may also be utilized to initiate an explosive release with a separate feeding of an extinguishing agent into the pipeline from a container with overpressure.

SUMMARY OF THE INVENTION

It is the primary object of this invention to simplify the control and use of the valve and the pressure medium. According to the present invention only an electric lighter is required which reduces the costs of the new device to a large extent in relation to what has been the case before.

This object of the invention is achieved by means of a device of the kind mentioned above, in which a container for the fire extinguishing agent is connected to the valve via a line for an extinguishing agent so that such an agent passing out of the container will initiate, on one hand, a release of the valve and, on the other hand, reinforce its effect by extinguishing or smothering any burning or glowing particles which may be present within the pipeline in connection with the valve. Thus, the extinguishing agent used has two essential functions in a construction of this kind. It is used, on one hand, to activate the valve and, on the other hand, to extinguish burning or glowing particles or objects.

The line containing the extinguishing agent can be directly connected to the pipeline via the valve. Moreover, the line can include one or more branch lines in the direction of flow before and/or after the connected valve. Each branch line ends separately in the pipeline. The container consists preferably of a metal bottle, the extinguishing agent preferably consisting of compressed halogen or nitrogen gas.

BRIEF DESCRIPTION OF THIS DRAWING

The invention will be described in greater detail below in the form of some preferred illustrative examples with reference to the enclosed drawing.

DETAILED DESCRIPTION

Figure 1:
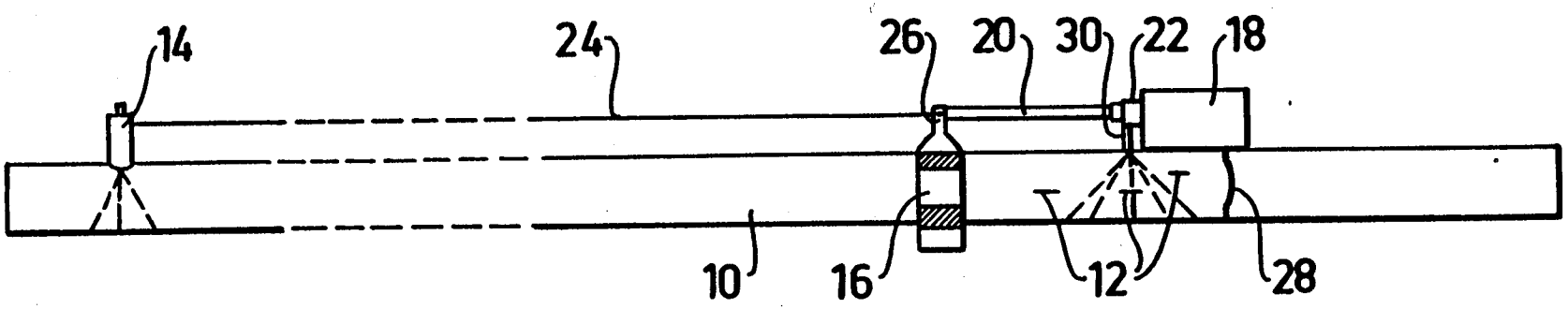
FIG. 1 is a lateral section of a part of a pipeline provided with a fire risk detector and a device formed according to the principles of the invention. The arrangement is illustrated in a considerably simplified form.

In FIG. 1 a section of a pipeline 10 is shown, which extends, in a way not shown in detail, from a place, e.g., for working or drying a material, to the following process station unit or units, such as cyclones, silos or filters in which a fire or explosion may arise due to glowing or burning particles 12 brought along in the pipeline 10. A detector 14 for sensing or indicating the burning or glowing particles 12 is placed in a so-called disturbance zone along the line at a suitable distance from the place for working or drying so that "innocent" sparks which may have existed in the particles being conveyed would have sufficient time to become extinguished before they reach this zone. Burning or glowing particles 12 are extinguished in a zone immediately adjacent the front of the sensitive process stations or units (not shown). These are the very risk zones in the construction.

The length of the extinguishing zone should be adapted so that any glowing or burning particles 12 will be extinguished or rendered harmless before they reach the risk zone. Thus, this is done at any early stage in the process by means of the device formed according to the invention, the main constituents of which are a container 16 with fire extinguishing agent and a valve 18 connected to the container.

According to FIG. 1 the container 16 with the fire extinguishing agent, which consists of a metal bottle, is directly connected to the release means 22 of the valve 18 via a line 20 for extinguishing agent.

An electric signal received from the detector 14 and indicating that burning or glowing particles 12 are present in the sensing zone of the detector 14 is transmitted via an electric line 24 to a lighter in connection with a pin release means 26 of the container 16. The pin release means 26 will act very rapidly due to its explosive release. When the pin release means 26 is activated by the electric signal, the lock to the contents of the container 16 is removed and the highly compressed fire extinguishing agent will stream out into the line 20 for extinguishing agent so that the release means 22 of the valve 18, will be actuated. The resilient deformable membrane 28 of the valve 18 which is a flap and valve in this case is now brought out of a normal opening position, in which the membrane 28 bears against the inner surface of the pipeline 10, and is formed according to this, to the closing position shown on the drawing, in which the membrane 28 is substantially perpendicular to the longitudinal direction of the pipe line 10.

In the embodiment illustrated in FIG. 1 the fire extinguishing agent passes through line 30 into the pipe line 10 for extinguishing or smothering burning and glowing particles 12 when the valve 18 is opened over a part of pipe line 10. In this way all extinguishing agent is utilized and performs a double function of extinguishing sparks and actuating a valve which prevents sparks from progressing from beyond a predetermined point in the pipeline to better insure their exposure to the fire extinguishing agent.

Figure 2:
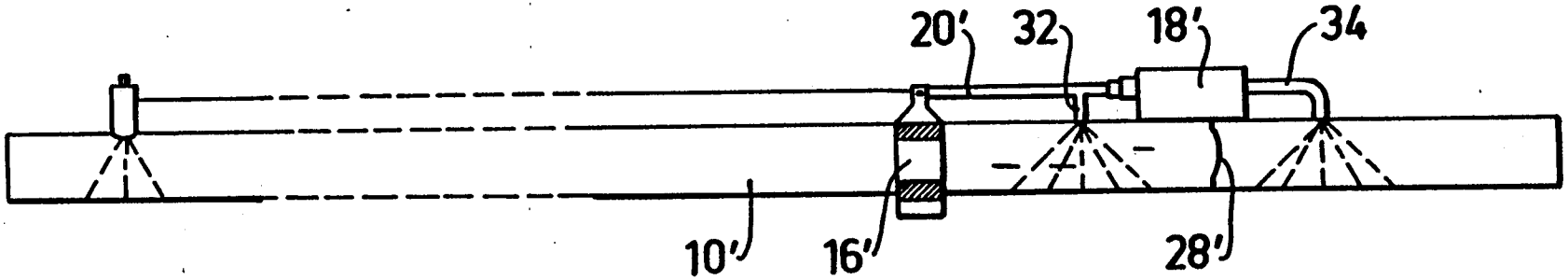
FIG. 2 shows also in lateral section an arrangement having essential similarities to the arrangement in FIG. 1. However, the device embodied according to the invention is somewhat modified.

In the embodiment shown in FIG. 2 the line 20' for extinguishing agent is provided with a branch line 32 and 34, respectively, before as well as after the flap valve 28', said branch lines 32 and 34 also ending in the pipeline 10'. In this arrangement extinguishing agent will be sprayed on both sides of the membrane 28' illustrated in the closed position. In this way, additional safety is obtained in case a spark or the like has somehow passed by the valve 28' before the flap valve 28 has been brought to closing position.

The container 16;16' illustrated on the drawing typically contains halogen or nitrogen gas having a high efficiency for the purpose intended.

In order to obtain the required compressive effect for activating the release means 22;22' of the valve 18;18' the line 20;20' for extinguishing agent and its branch lines 30;32,34 are dimensioned with a predetermined mutual cross-sectional ratio. Furthermore, short lines are preferred everywhere as these will give more rapid reactions and consequently better safety.

As mentioned above, a membrane valve is illustrated on the drawing, but of course other valves can also be used, for example a slide valve with a pneumatic cylinder.

Modifications of the device described above can be made within the scope of the following claims.

I claim:

1. A device for eliminating the risk of fire due to hot particles being conveyed through a pipeline, said device comprising a pipeline; a heat sensitive detector in communication with said pipeline; a flap valve comprising a resilient deformable membrane which is pivotable between an open position, in which the membrane bears upon an inner surface of said pipeline, and a closing position in which said membrane is perpendicular to a longitudinal axis of said pipeline, and a pin release adapted to be actuated by an extinguishing agent, said flap valve being operably connected to said heat sensitive detector to block said pipeline when a risk of fire is detected in said pipeline; and a container comprising a compressed extinguishing agent adapted to be fed via a conduit for said compressed extinguishing agent into said pipeline when said pipeline is blocked by said flap valve, wherein said container is operably connected to said flap valve via said conduit so that, as said compressed extinguishing agent passes out of said container via said conduit, said extinguishing agent initiates a release of said flap valve to block said pipeline and extinguishes said hot particles within said pipeline.

2. The device of claim 1, wherein said container is connected through a line for said extinguishing agent to said pipeline via said flap valve.

3. The device of claim 2, wherein said conduit for said compressed extinguishing agent comprises at least two branch pipes terminating in said pipeline, wherein one of said at least two branch pipes terminates before said flap valve and another said at least two branch pipes terminates after said flap valve relative to the direction of flow in said pipeline.

4. The device of claim 1, wherein said container comprises a metal bottle.

5. The device of claim 4, wherein said compressed extinguishing agent is a member selected from the group consisting of halogen gas and nitrogen gas.

* * * * *